US010415443B2

(12) United States Patent
Nagai et al.

(10) Patent No.: US 10,415,443 B2
(45) Date of Patent: Sep. 17, 2019

(54) ENGINE

(71) Applicant: KUBOTA Corporation, Osaka-shi, Osaka (JP)

(72) Inventors: Kentaro Nagai, Sakai (JP); Takahiro Yamazaki, Sakai (JP); Takahito Hamasaki, Sakai (JP); Hideyuki Goto, Sakai (JP); Hiroki Oso, Sakai (JP); Hideyuki Koyama, Sakai (JP); Akira Tanaka, Sakai (JP); Yoshinori Tanaka, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 47 days.

(21) Appl. No.: 15/177,444

(22) Filed: Jun. 9, 2016

(65) Prior Publication Data

US 2016/0363017 A1 Dec. 15, 2016

(30) Foreign Application Priority Data

Jun. 11, 2015 (JP) ..... 2015-118484
Dec. 29, 2015 (JP) ..... 2015-257653

(51) Int. Cl.
*F01M 13/00* (2006.01)
*F01M 13/04* (2006.01)

(52) U.S. Cl.
CPC ..... *F01M 13/04* (2013.01); *F01M 13/0011* (2013.01); *F01M 13/0416* (2013.01);
(Continued)

(58) Field of Classification Search
CPC ..... F01M 13/04; F01M 13/0011; F01M 13/0416; F01M 2013/0038; F01M 2013/045; F01M 2013/0488
See application file for complete search history.

(56) References Cited

U.S. PATENT DOCUMENTS 7,631,639 B2 * 12/2009 Yonebayashi ..... F01M 13/0416 123/572
8,480,777 B2 * 7/2013 Sakaguchi ..... F01M 13/0416 123/198 E (Continued)

FOREIGN PATENT DOCUMENTS

DE 102010003816 A1 10/2010
FR 2789125 A1 8/2000

(Continued)

OTHER PUBLICATIONS

Extended European Search Report dated Nov. 11, 2016 in EP Application No. 16173472.8.

(Continued)

*Primary Examiner* — Joseph J Dallo
*Assistant Examiner* — Kurt Philip Liethen
(74) *Attorney, Agent, or Firm* — Panitch Schwarze Belisario & Nadel LLP

(57) ABSTRACT

There is provided an engine capable of reducing oil consumption. The engine includes a cylinder head, a cylinder head cover mounted above the cylinder head, a rocker arm covered by the cylinder head cover, and a breather chamber provided inside the cylinder head cover. As a front-rear direction is defined by a longitudinal direction of the cylinder head cover, the breather chamber has a blow-by gas inlet at one side in the front-rear direction, a blow-by gas outlet at another side in the front-rear direction, and an oil discharging guide chamber at an intermediate part in the front-rear direction. The blow-by gas inlet is opened on a bottom wall of the breather chamber, and a peripheral wall of the oil discharging guide chamber is protruded downwardly from the bottom wall of the breather chamber toward between the rocker arm provided at a side of the blow-by gas outlet and the blow-by gas inlet.

21 Claims, 21 Drawing Sheets

(52) U.S. Cl.
CPC ..... *F01M 2013/0038* (2013.01); *F01M 2013/045* (2013.01); *F01M 2013/0488* (2013.01)

(56) References Cited

U.S. PATENT DOCUMENTS

| | | | | |
|---|---|---|---|---|
| 8,726,876 | B2 * | 5/2014 | Kobayashi | F01M 13/0416 123/196 CP |
| 2004/0099193 | A1 * | 5/2004 | Matsuda | F01M 13/04 114/55.5 |
| 2007/0062679 | A1 * | 3/2007 | Agee | F28F 9/02 165/158 |
| 2007/0295315 | A1 * | 12/2007 | Guerry | F01M 13/04 123/572 |
| 2009/0064642 | A1 * | 3/2009 | Sato | F01M 13/022 55/290 |
| 2010/0147235 | A1 * | 6/2010 | Festag | F01M 13/0416 123/41.86 |
| 2011/0179755 | A1 * | 7/2011 | Gruhler | B29C 65/58 55/320 |

FOREIGN PATENT DOCUMENTS

| | | | | |
|---|---|---|---|---|
| JP | S57171110 | U | | 10/1982 |
| JP | S58108215 | U | | 7/1983 |
| JP | S58183218 | U | | 12/1983 |
| JP | S59-127807 | U | | 8/1984 |
| JP | H02035912 | A | | 2/1990 |
| JP | H08260936 | A | | 10/1996 |
| JP | H09189212 | A | | 7/1997 |
| JP | H11210437 | A | | 8/1999 |
| JP | 2000045749 | A | * | 2/2000 |
| JP | 2007138827 | A | | 6/2007 |
| JP | 2007263066 | A | | 10/2007 |
| JP | 2008115800 | A | | 5/2008 |
| JP | 2008157047 | A | | 7/2008 |
| NO | 2011090956 | A2 | | 7/2011 |

OTHER PUBLICATIONS

Office Action dated Sep. 25, 2018 in JP Application No. 2015257653.
Office Action dated Mar. 20, 2018 in JP 2015-118484.

* cited by examiner

ENGINE

BACKGROUND OF THE INVENTION (1) Field of the Invention

The present invention relates to an engine.

(2) Description of Related Art

However, in the conventional engine, since a blow-by gas inlet is opened on a bottom wall of the breather chamber and the bottom wall of the breather chamber is formed in a flat shape, a problem has arisen.

<<Problem>> the Oil Consumption Might be Increased

In the conventional engine, the oil splashed up by the rocker arm is apt to enter into the blow-by gas inlet with a stream of the blow-by gas along the bottom wall of the breather chamber, and therefore an oil amount entered into the breather chamber becomes excessive and some oil, which is not separated from the blow-by gas inside the breather chamber, is leaked from the cylinder head cover. This configuration might lead an increase of the oil consumption.

SUMMARY OF THE INVENTION

An object of the present invention is to provide an engine capable of reducing oil consumption.

The present invention is described below.

An engine has a cylinder head, a cylinder head cover mounted above the cylinder head, a rocker arm covered by the cylinder head cover, and a breather chamber provided in the cylinder head cover.

As a front-rear direction is defined by a longitudinal direction of the cylinder head cover, the breather chamber has a blow-by gas inlet at one side in the front-rear direction, a blow-by gas outlet at another side in the front-rear direction, and an oil discharging guide chamber at an intermediate position in the front-rear direction.

The blow-by gas inlet is opened on a bottom wall of the breather chamber, a peripheral wall of the oil discharging guide chamber is protruded downwardly from the bottom wall of the breather chamber between the rocker arm provided at a side of the blow-by gas outlet and the blow-by gas inlet.

According to the present invention, the following effects are attained.

<<Effect>> the Oil Consumption can be Reduced

Even when the oil splashed up by the rocker arm provided at the side of the blow-by gas outlet is flowed with the stream of the blow-by gas along the bottom wall of the breather chamber, the stream is prevented from flowing by the peripheral wall of the oil discharging guide chamber, and therefore the oil entering amount into the blow-by gas inlet is reduced, the oil entering amount into the breather chamber is optimized, the leaking of the oil from the cylinder head cover is prevented, and the oil consumption can be reduced.

<<Effect>> an Engine Noise Emitted from the Cylinder Head Cover can be Reduced The rigidness of the bottom wall of the breather chamber is increased, and therefore the bottom wall is hardly vibrated and the engine noise emitted from the cylinder head cover via the vibration can be reduced.

BRIEF DESCRIPTION OF THE DRAWINGS

FIG. 8A is a basic example, FIG. 8B is a first modified example and FIG. 8C is a second modified example; FIG. 9A is a diagram corresponding to FIG. 3 and FIG. 9B is a diagram corresponding to FIG. 5.

FIG. 10A is a vertical cross-sectional view, FIG. 10B is a top view taken in a direction of an arrow B in FIG. 10A, and FIG. 10C is a cross-sectional view taken along line C-C in FIG. 10A;

FIG. 11A is a vertical cross-sectional view of a first modified example, FIG. 11B is a vertical cross-sectional view of a second modified example, FIG. 11C is a vertical cross-sectional view of a third modified example, and FIG. 11D is a top view taken along in a direction of an arrow D in FIG. 11C;

FIG. 12A is a vertical cross-sectional view of the first modified example, FIG. 12B is a cross-sectional view taken along line B-B in FIG. 12A, FIG. 12C is a vertical cross-sectional view of the second modified example, FIG. 12D is a bottom view taken along in a direction of an arrow D in FIG. 12C, FIG. 12E is a bottom view corresponding to FIG. 12D in a valve opening state, and FIG. 12F is a vertical cross-sectional view of the third modified example;

FIG. 13A is a vertical cross-sectional view of the fourth modified example, FIG. 13B is a cross-sectional view taken along line B-B in FIG. 13A, and FIG. 13C is a vertical cross-sectional view of the fifth modified example; FIG. 14A is a basic example, FIG. 14B is a first modified example, and FIG. 14C is a second modified example.

FIG. 15A is an exploded perspective view of a cylinder head cover and a bottom wall of a breather chamber, and FIG. 15B is a cross-sectional view taken along line B-B in FIG. 15A; FIG. 16A is a vertical cross-sectional view, FIG. 16B is a top view taken along in a direction of an arrow B in FIG. 16A, and FIG. 16C is a cross-sectional view taken along line C-C in FIG. 16A.

FIG. 17A is a front view, FIG. 17B is a side view taken along in a direction of an arrow B in FIG. 17A, FIG. 17C is a side view taken along in a direction of an arrow C in FIG. 17A, FIG. 17D is a plane view, FIG. 17E is a bottom view, FIG. 17F is a cross-sectional view taken along line F-F in FIG. 17D, and FIG. 17G is a cross-sectional view taken along line G-G in FIG. 17D;

FIG. 18A is a front view, FIG. 18B is a side view taken along in a direction of an arrow B in FIG. 18A, FIG. 18C is a side view taken along in a direction of an arrow C in FIG. 18A, FIG. 18D is a plane view, FIG. 18E is a bottom view, FIG. 18F is a cross-sectional view taken along line F-F in FIG. 18D, and FIG. 18G is a cross-sectional view taken along line G-G in FIG. 18D;

FIG. 19A is a front view, FIG. 19B is a side view taken along in a direction of an arrow B in FIG. 19A, FIG. 19C is a side view taken along in a direction of an arrow C in FIG. 19A, FIG. 19D is a plane view, FIG. 19E is a bottom view, FIG. 19F is a cross-sectional view taken along line F-F in FIG. 19D, and FIG. 19G is a cross-sectional view taken along line G-G in FIG. 19D;

FIG. 20A is a front view, FIG. 20B is a side view taken along in a direction of an arrow B in FIG. 20A, FIG. 20C is a side view taken along in a direction of an arrow C in FIG. 20A, FIG. 20D is a plane view, FIG. 20E is a bottom view, FIG. 20F is a cross-sectional view taken along line F-F in FIG. 20D, and FIG. 20G is a cross-sectional view taken along line G-G in FIG. 20D;

FIG. 21A is a front view, FIG. 21B is a side view taken along in a direction of an arrow B in FIG. 21A, FIG. 21C is a side view taken along in a direction of an arrow C in FIG. 21A, FIG. 21D is a plane view, FIG. 21E is a bottom view, FIG. 21F is a cross-sectional view taken along line F-F in FIG. 21D, and FIG. 21G is a cross-sectional view taken along line G-G in FIG. 21D;

FIG. 22A is a front view, FIG. 22B is a side view taken along in a direction of an arrow B in FIG. 22A, FIG. 22C is a side view taken along in a direction of an arrow C in FIG. 22A, FIG. 22D is a plane view, FIG. 22E is a bottom view, FIG. 22F is a cross-sectional view taken along line F-F in FIG. 22D, and FIG. 22G is a cross-sectional view taken along line G-G in FIG. 22D; FIG. 23A is a front view, FIG. 23B is a side view taken along in a direction of an arrow B in FIG. 23A, FIG. 23C is a side view taken along in a direction of an arrow C in FIG. 23A, FIG. 23D is a plane view, FIG. 23E is a bottom view, FIG. 23F is a cross-sectional view taken along line F-F in FIG. 23D, and FIG. 23G is a cross-sectional view taken along line G-G in FIG. 23D.

DETAILED DESCRIPTION OF PREFERRED EMBODIMENTS

FIGS. 1 to 14 show an engine according to a first embodiment of the present invention, FIGS. 15 to 23 show an engine according to a second embodiment of the present invention, and each embodiment is described by using a vertical type in-line two-cylinder diesel engine.

An outline of the engine according to the first embodiment is as follows.

Figure 2:
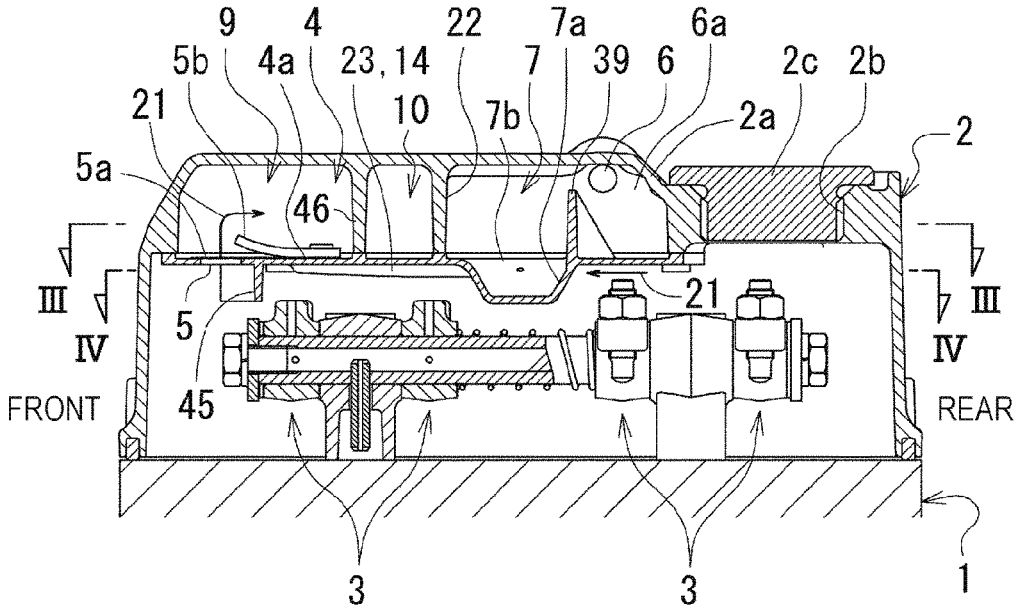
FIG. 2 is a vertical cross-sectional view of an upper part of the engine according to the first embodiment of the present invention.

As shown in FIG. 2, a cylinder head (1) is mounted above a cylinder block (not shown), and a cylinder head cover (2) is mounted above the cylinder head (1). As a front-rear direction is defined by the installation direction of a crank shaft (not shown), its one side is defined as the front and another side is defined as the rear.

An oil pan (not shown) is mounted below the cylinder block (not shown).

A swirl chamber (not shown) is formed in the cylinder head (1), and fuel is injected into the swirl chamber (not shown) from a fuel injection pump (not shown) via a fuel injection pipe (not shown) and a fuel injection nozzle (not shown).

Figure 7:
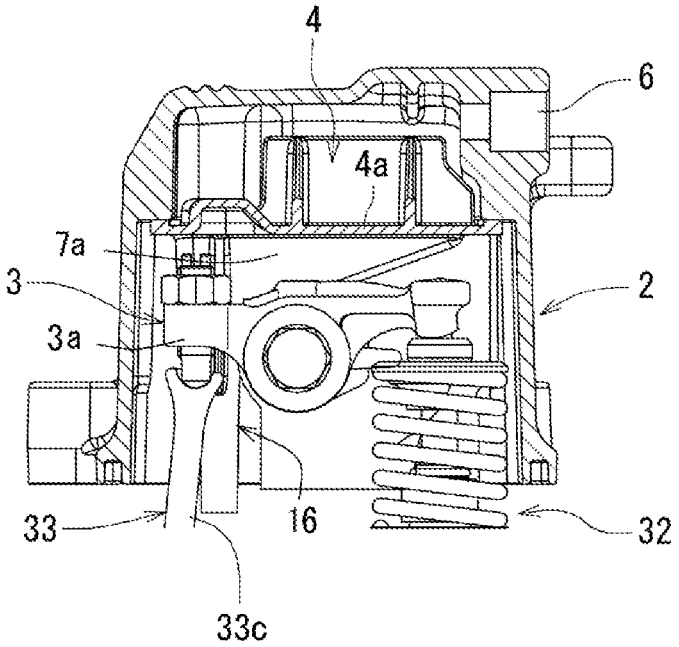
FIG. 7 is a cross-sectional view taken along line VII-VII line in FIG. 3.

As shown in FIG. 7, a valve device (32) for intake air and exhaust air is housed in the cylinder head cover (2), and the valve device (32) is driven by a valve driving device (33). The valve driving device (33) is provided with a valve driving cam (not shown), a tappet (not shown), a push rod (33*c*) and a rocker arm (3). The push rod (33*c*) is housed in a push rod chamber (33*d*) shown in FIG. 4. Blow-by gas (21) inside a crank case (not shown) is entered into the cylinder head cover (2) via the push rod chamber (33*d*).

Figure 1:
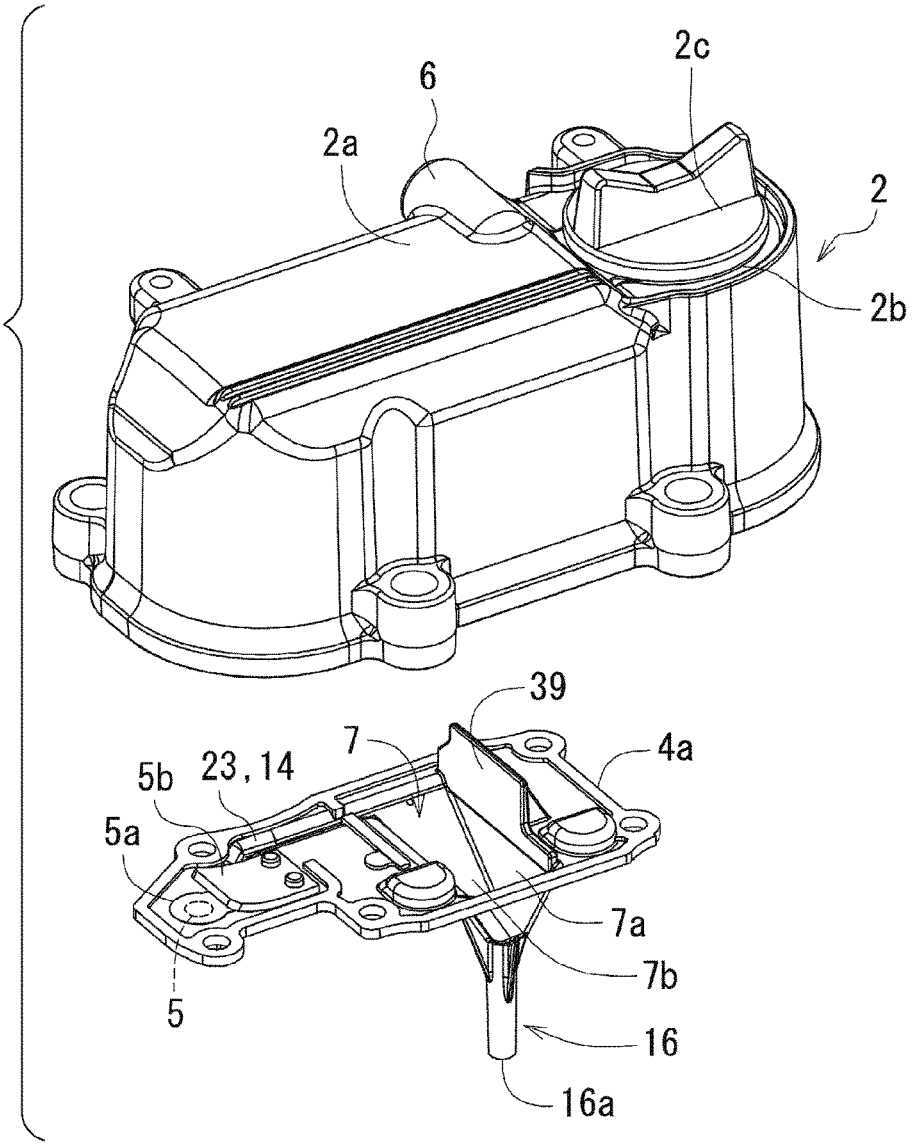
FIG. 1 is an exploded perspective view of a cylinder head cover of an engine and a bottom wall of a breather chamber according to a first embodiment of the present invention.

As shown in FIG. 1, a bottom wall (4*a*) of a breather chamber (4) is mounted inside the cylinder head cover (2) from a lower side of the cylinder head cover (2). A fuel supply hole (2*b*) is opened on a top wall (2*a*) of the cylinder head cover (2), and the fuel supply hole (2*b*) is covered by a detachable cover (2*c*).

The bottom wall (4*a*) of the breather chamber (4) is formed of synthetic resin. The cylinder head cover (2) is formed of aluminum diecast.

As shown in FIG. 2, the engine is provided with the cylinder head (1), the cylinder head cover (2) mounted above the cylinder head (1), the rocker arm (3) covered by the cylinder head cover (2), and the breather chamber (4) provided in the cylinder head cover (2).

With such a configuration, oil splashed up by the rocker arm (3) is passed through the breather chamber (4) together with the blow-by gas (21), and the oil is separated from the blow-by gas (21) in the breather chamber (4). Accordingly, leaking of the oil from the cylinder head cover (2) can be prevented and oil consumption can be suppressed.

Figure 3:
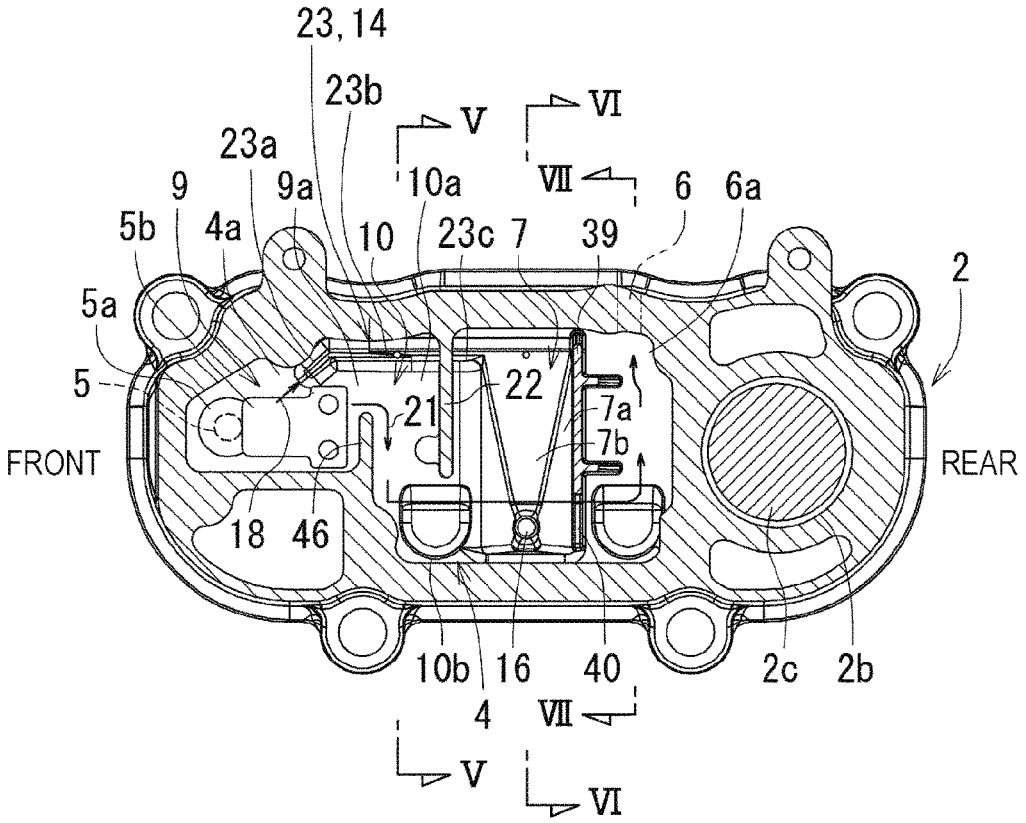
FIG. 3 is a cross-sectional view taken along line in FIG. 2.

As shown in FIGS. 2 and 3, as the front-rear direction is defined by a longitudinal direction of the cylinder head cover (2), the breather chamber (4) has a blow-by gas inlet (5) at its front side, a blow-by gas outlet (6) at its rear side, and an oil discharging guide chamber (7) at an intermediate position in the front-rear direction. Alternatively, the blow-by gas inlet (5) may be provided at the rear side and the blow-by gas outlet (6) may be provided at the front side.

Figure 4:
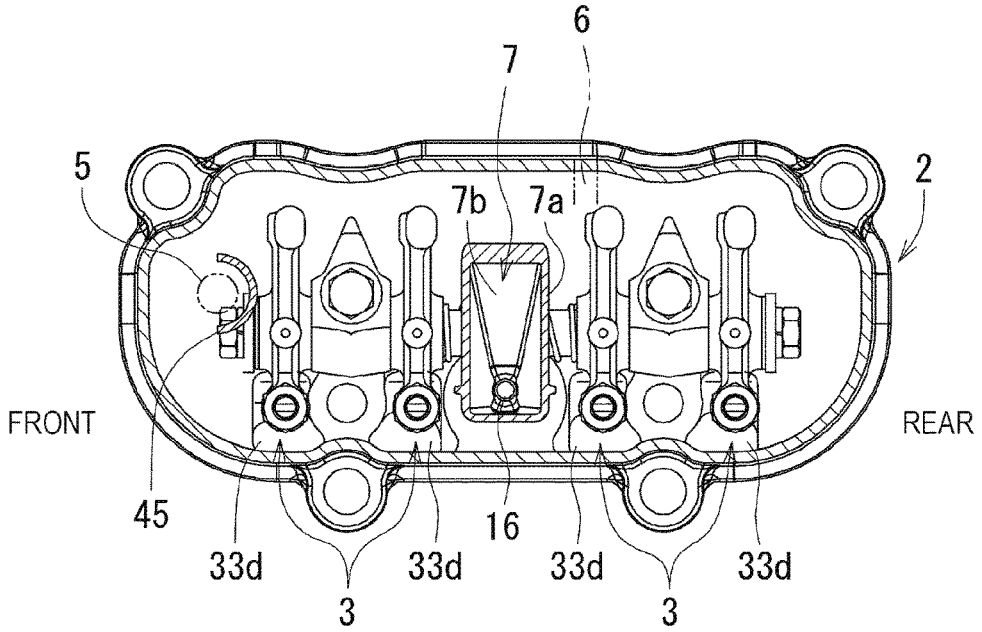
FIG. 4 is a cross-sectional view taken along line IV-IV line in FIG. 2.
Figure 5:
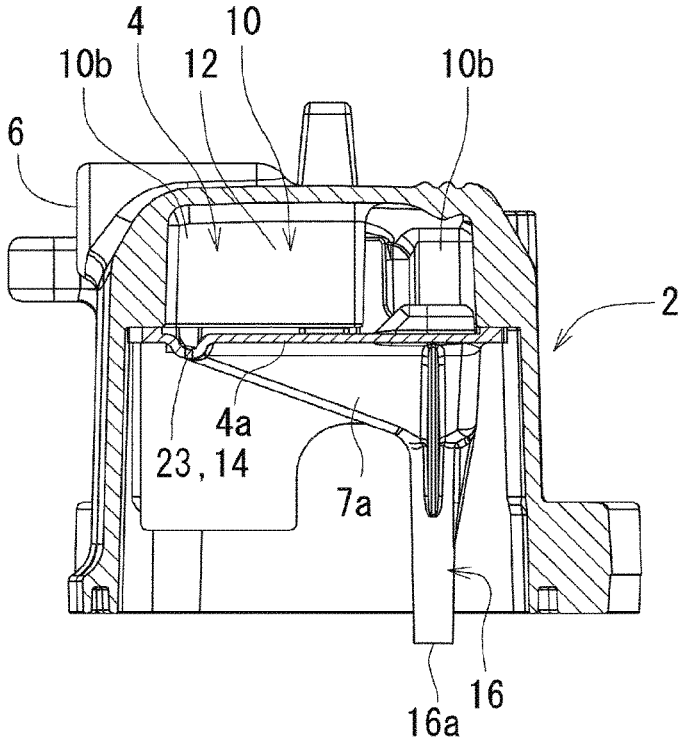
FIG. 5 is a cross-sectional view taken along line V-V line in FIG. 3.
Figure 6:
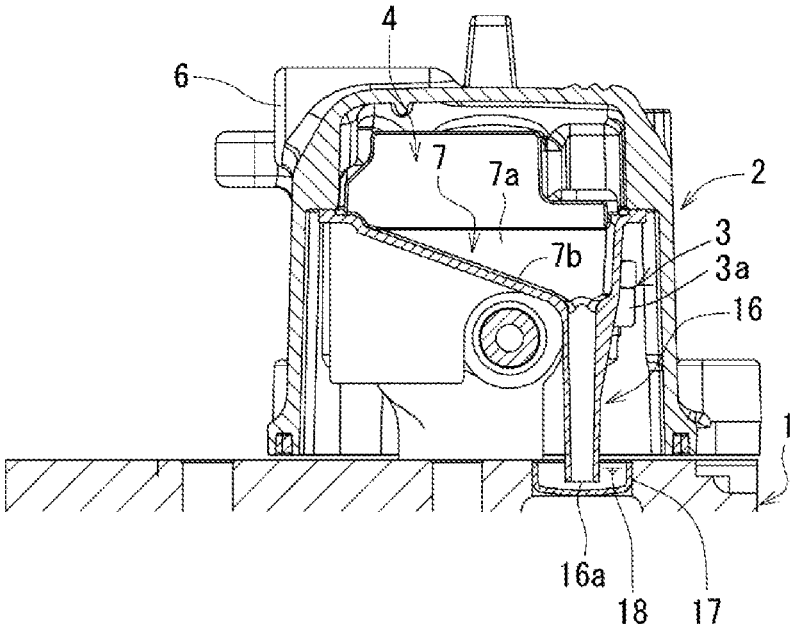
FIG. 6 is a cross-sectional view taken along line VI-VI line in FIG. 3.

As shown in FIGS. 2 and 4, the blow-by gas inlet (5) is opened on the bottom wall (4*a*) of the breather chamber (4), and a peripheral wall (7*a*) of the oil discharging guide chamber (7) is protruded downwardly from the bottom wall (4*a*) of the breather chamber (4) between the rocker arm (3) provided at a side of the blow-by gas outlet (6) and the blow-by gas inlet (5).

With such a configuration, as shown in FIG. 2, when the oil splashed up by the rocker arm (3) provided at the side of the blow-by gas outlet (6) is flowed with the stream of the blow-by gas (21) along the bottom wall (4*a*) of the breather chamber (4), the stream is prevented from flowing by the peripheral wall (7*a*) of the oil discharging guide chamber (7), and therefore the oil entering amount entered into the blow-by gas inlet (5) is reduced, and the oil entering amount into the breather chamber (4) is optimized. Accordingly, the leaking of the oil from the cylinder head cover (2) is prevented, and the oil consumption can be reduced. Further, the rigidness of the bottom wall (4*a*) of the breather chamber (4) is increased, and therefore the bottom wall (4*a*) is hardly vibrated and the engine noise emitted from the cylinder head cover (2) via the vibration can be reduced.

As shown in FIGS. 2 and 3, a lead valve (5*a*) is mounted to the blow-by gas inlet (5). The opened lead valve (5) is received by a stop plate (5*b*). In an inlet side oil separating chamber (9), oil mist included in the blow-by gas (21) entered into the blow-by gas inlet (5) is separated from the blow-by gas (21) by collapsing the blow-by gas (21) against the lead valve (5*a*), and then the oil is separated by condensing the oil mist on a chamber wall.

A baffle plate (45) is protruded downwardly from the bottom wall (4*a*) of the breather chamber (4) between the rocker arm (3) provided at the side of the blow-by gas inlet (5) and the blow-by gas inlet (5). With such a configuration, the stream of the blow-by gas (21) along the bottom wall (4*a*) of the breather chamber (4) is prevented from flowing by the baffle plate (45), and an oil entering amount into the blow-by gas inlet (5) is reduced. The baffle plate (45) is formed integrally with the bottom wall (4*a*) of the breather chamber (4).

As shown in FIGS. 2 and 3, the breather chamber (4) is provided with the inlet side oil separating chamber (9) having the blow-by gas inlet (5), and a blow-by gas bypass passage (10). The blow-by gas (21) coming out of the inlet side oil separating chamber (9) is guided to the oil discharging guide chamber (7) via the blow-by gas bypass passage (10).

With such a configuration, the blow-by gas (21) is processed by an oil separating processing consecutively in the inlet side oil separating chamber (9) and the blow-by gas bypass passage (10), and therefore the oil separation of the blow-by gas (21) is promoted.

The inlet side oil separating chamber (9) is formed in an elongated shape in the front-rear direction, and the blow-by gas bypass passage (10) is formed in an elongated shape in a lateral direction. The inlet side oil separating chamber (9) and the blow-by gas bypass passage (10) are communicated with each other at an opening (9*a*) at the rear side of the inlet side oil separating chamber (9). The oil mist included in the blow-by gas (21) entered from the opening (9*a*) into the blow-by gas bypass passage (10) is condensed on a passage wall and the oil separation is performed.

A first partition wall (46) which separates the inlet side oil separating chamber (9) and the blow-by gas bypass passage (10) is formed in an elongated shape in a lateral direction and formed integrally with the cylinder head cover (2) to protrude downwardly from the top wall (2*a*).

As shown in FIG. 3, the breather chamber (4) is provided with a second partition wall (22) which separates the blow-by gas bypass passage (10) and the oil discharging guide chamber (7), and a separated oil guide passage (23). The separated oil guide passage (23) has a start part (23*a*) provided in the inlet side oil separating chamber (9), an intermediate part (23*b*) provided at the start part (10*b*) of the blow-by gas bypass passage (10), and an end part (23*c*) provided below the second partition wall (22) such that the separated oil guide passage (23) is led to the oil discharging guide chamber (7).

With such a configuration, a length of the separated oil guide passage (23) can be shortened, and the separated oil (18) can be guided quickly to the oil discharging guide chamber (7).

Further, the separated oil guide passage (23) is provided below the second partition wall (22) and the end part (23*c*) of the separated oil guide passage (23) is blocked by the separated oil (18), and therefore the blow-by gas (21) is hardly entered into the oil discharging guide chamber (7) via the separated oil guide passage (23).

The second partition wall (22) which separates the blow-by gas bypass passage (10) and the oil discharging guide chamber (7) is formed in an elongated shape in the lateral direction, and the second partition wall (22) is formed integrally with the cylinder head cover (2) to protrude downwardly from the top wall (2*a*).

As shown in FIG. 3, the separated oil guide passage (23) is formed by a groove (14).

With such a configuration, the separated oil (18) separated at the inlet side oil separating chamber (9) or the start part (10*a*) of the blow-by gas bypass passage (10) flows quickly into the groove (14) from an upper opening of the groove (14) and passes through the groove (14) with a small flow resistance, and therefore the separated oil (18) is guided quickly.

Further, in a case in which the separated oil guide passage (23) is formed by the groove (14), the separated oil (18) might be contacted with the blow-by gas (21) passing the blow-by gas bypass passage (10) when the separated oil (18) passes through the separated oil guide passage (23). However, as described above, since the length of the separated oil guide passage (23) can be shortened, the separated oil (18) is hardly contacted with the blow-by gas (21) and is hardly turned into mist again. Further, even if the separated oil (18) is turned into mist, the oil is separated again in the downstream blow-by gas bypass passage (10). Thus, the separated oil (18) is hardly turned into mist again.

Figure 8A:
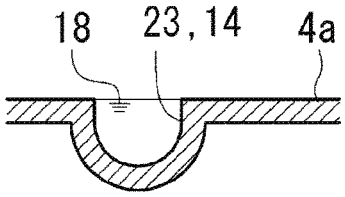
FIGS. 8A to 8C show a separated oil guide passage used in the engine according to the first embodiment of the present invention, in particular.

The groove (14) has a half circle section in a basic example shown in FIG. 8A.

Figure 8B:
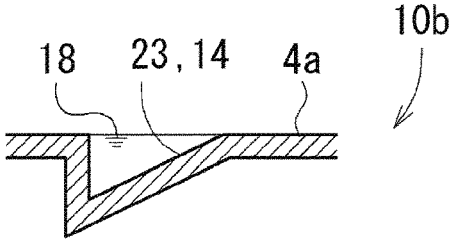

However, the groove (14) may have a wedge-shaped section as a first modified example shown in FIG. 8B, and an inner bottom surface of the groove (14) may be formed such that a depth of the groove (14) becomes small asymptotically toward a side of the end part (10*b*) of the blow-by gas bypass passage (10).

Figure 8C:
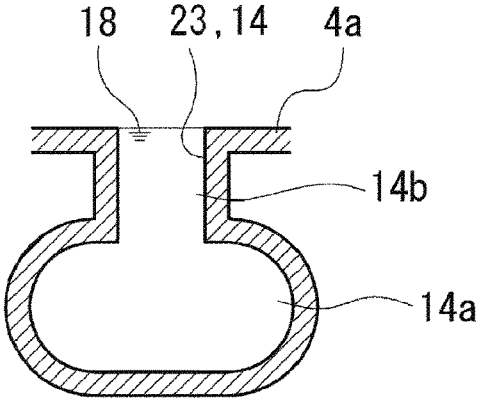

Further, the groove (14) may have a flask-like shaped section as a second modified example shown in FIG. 8C. A width of a lower half part (14*a*) of the groove (14) may be larger than that of an upper half part (14*b*). With such a configuration, the separated oil (18) is quickly guided in the lower half part (14*a*) with a wide passage section, and the separated oil (18) is hardly contacted with the blow-by gas (21) in the upper half part (14*b*) with a narrow passage section. Accordingly, the separated oil (18) is hardly turned into mist again by the blow-by gas (21).

Figure 9A:
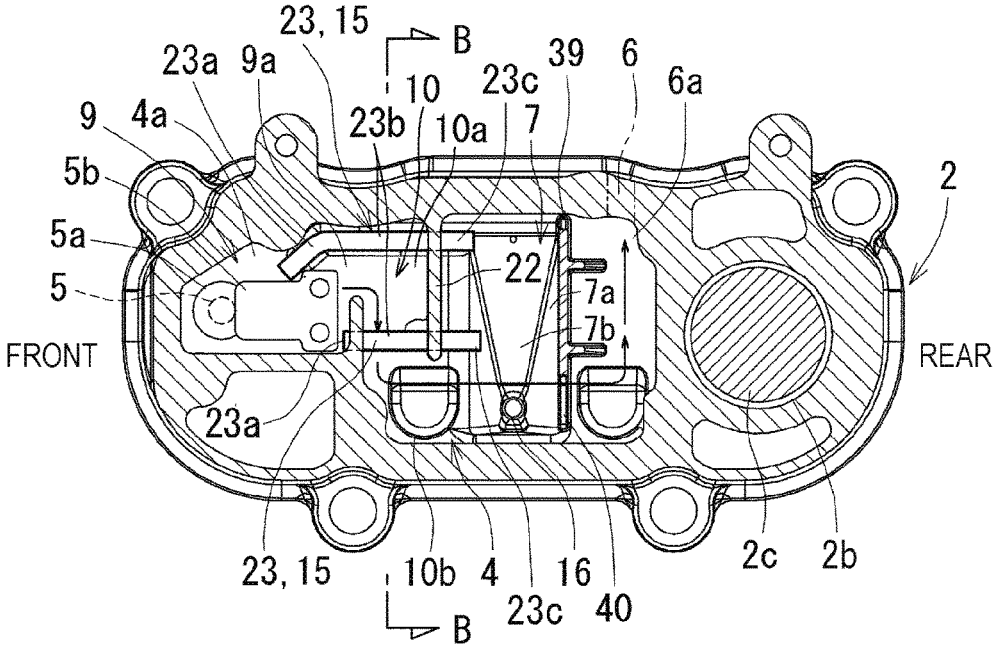
FIGS. 9A and 9B show a third modified example of the separated oil guide passage used in the engine according to the first embodiment of the present invention, in particular.
Figure 9B:
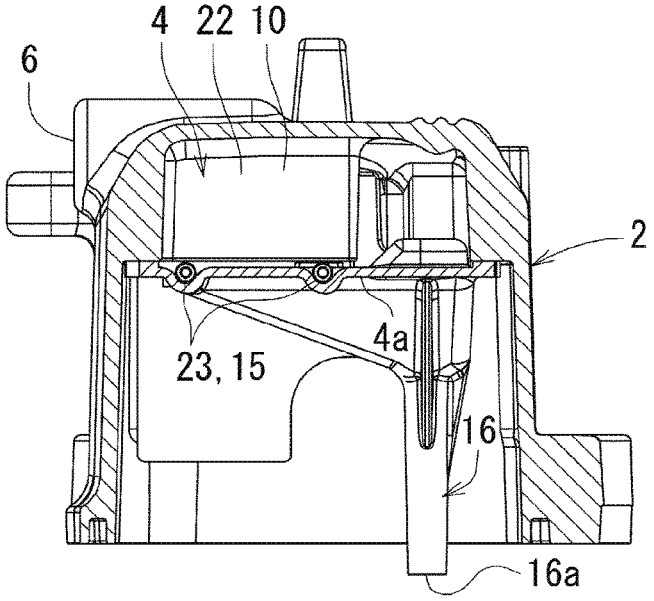

The separated oil guide passage (23) may be formed by a pipe (15) as a third modified example shown in FIGS. 9A and 9B.

In this case, an upper part of the separated oil guide passage (23) is covered and the separated oil (18) guided into the separated oil guide passage (23) is prevented from contacting the blow-by gas (21) passing the blow-by gas bypass passage (10), and therefore the separated oil (18) is hardly turned into mist again.

The pipe (15) may be also provided at a side of the end part (10*b*) of the blow-by gas bypass passage (10). The separated oil guide passage (23), which is formed by the pipe (15) provided at the side of the end part (10*b*) of the blow-by gas bypass passage (10), has the start part (23*a*) provided in the inlet side oil separating chamber (9), the intermediate part (23*b*) provided at the end part (10*b*) of the blow-by gas bypass passage (10), and the end part (23*c*) provided below the second partition wall (22) such that the separated oil guide passage (23) is led to the oil discharging guide chamber (7).

Figure 10B:
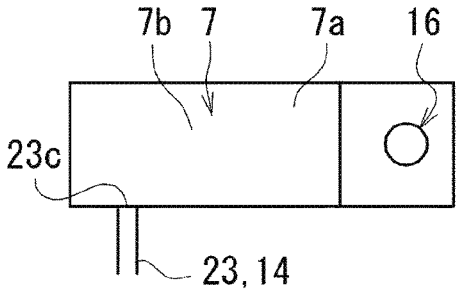
FIGS. 10A to 10C show the basic example of an oil discharging guide chamber used in the engine according to the first embodiment of the present invention, in particular.
Figure 10A:
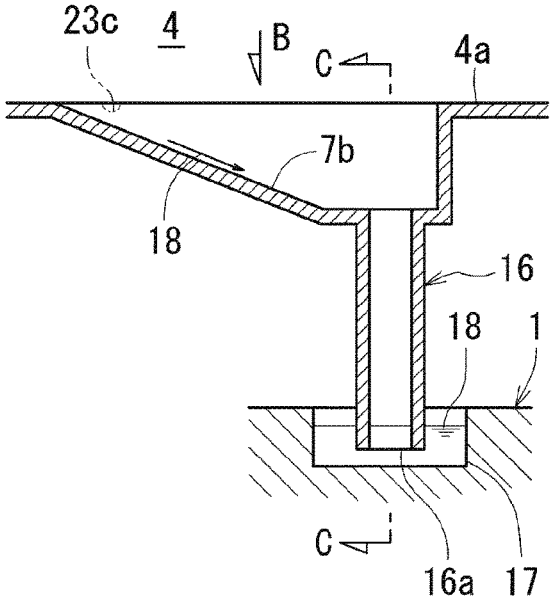

As shown in FIG. 10A, the breather chamber (4) has an oil discharging pipe (16) at a lower part of the oil discharging guide chamber (7). The oil discharging guide chamber (7) has an oil discharging guide surface (7*b*) on an inner surface of the oil discharging guide chamber (7). The oil discharging guide surface (7*b*) is inclined downwardly from the end part (23*c*) of the separated oil guide passage (23) toward the oil discharging pipe (16).

With such a configuration, the separated oil (18) is discharged smoothly.

It is presumed that a continuous oil film is formed on the downwardly inclined surface of the oil discharging guide surface (7*b*) by the separated oil (18) flowing on the inclined face, and therefore the following separated oil (18) is slipped downward smoothly on the surface of the oil film.

The oil discharging guide surface (7*b*) is formed by a flat inclined surface without projections and recesses in the basic example shown in FIG. 10A.

The oil discharging guide chamber (7) is formed in an elongated shape in the lateral direction, and a chamber wall of the oil discharging guide chamber (7) and the oil discharging pipe (16) are formed integrally with the bottom wall (4*a*) of the breather chamber (4) so as to protrude downwardly from the bottom wall (4*a*).

Figure 11A:
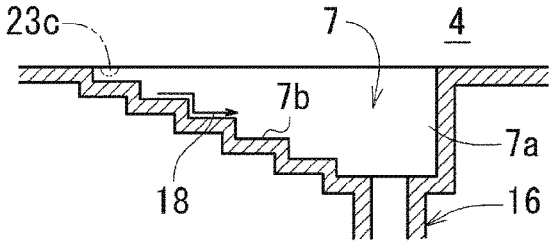
FIGS. 11A to 11D show modified examples of the oil discharging guide chamber used in the engine according to the first embodiment of the present invention, in particular.

The oil discharging guide surface (7*b*) may be formed by a stepped zigzag face inclined downwardly from the end part (23*c*) of the separated oil guide passage (23) toward the oil discharging pipe (16) as a first modified example shown in FIG. 11A.

In this case, when the engine is inclined toward a side of the oil discharging guide surface (7*b*), the separated oil (18) stays in a recess of the oil discharging guide surface (7*b*) formed by the zigzag face and therefore the separated oil (18) is hardly flowed back on the oil discharging guide surface (7*b*) when the engine is inclined.

Figure 11B:
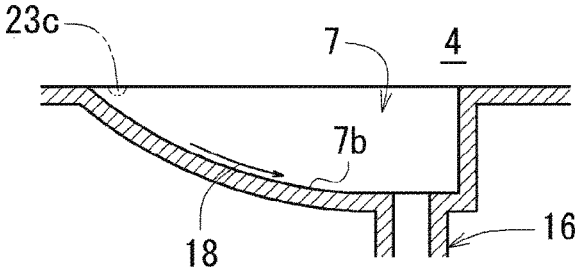

The oil discharging guide surface (7*b*) may be formed by a curved face with a cycloid curved line having a tangent downwardly inclined from the end part (23*c*) of the separated oil guide passage (23) toward the oil discharging pipe (16) when seen from the front as a second modified example shown in FIG. 11B.

In this case, the separated oil (18) is discharged smoothly.

It is presumed that a continuous oil film is formed on the downwardly inclined curved surface of the oil discharging guide surface (7*b*) by the separated oil (18) flowing down on the downwardly inclined curved face, and therefore the following separated oil (18) is smoothly slipped downward on the surface of the oil film at the shortest distance.

Figure 11C:
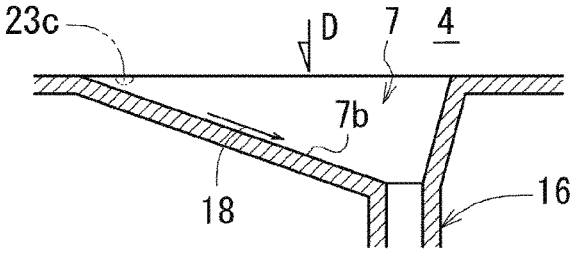
Figure 11D:
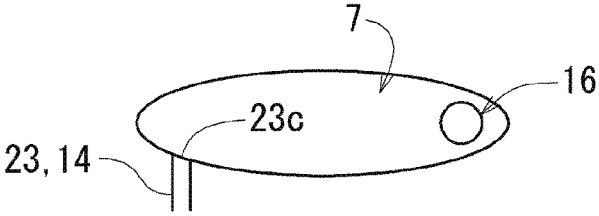

The oil discharging guide surface (7*b*) may be formed by a funnel-like curved face narrowed downwardly from the end part (23*c*) of the separated oil guide passage (23) toward the oil discharging pipe (16) as a third modified example shown in FIGS. 11C and 11D.

In this case, the separated oil (18) flows down smoothly on the downwardly inclined oil discharging guide surface (7*b*) regardless of which direction the engine is inclined to.

Figure 10C:
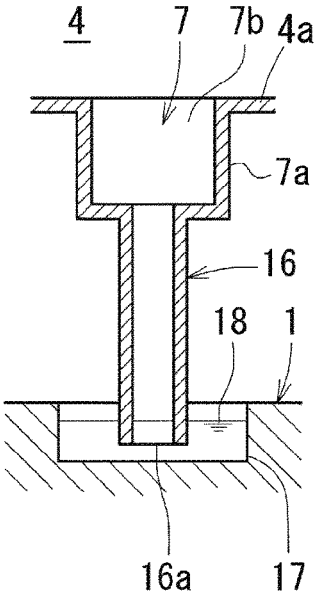

As shown in FIGS. 10A and 10C, the breather chamber (4) has the oil discharging pipe (16) at the lower part of the oil discharging guide chamber (7). The cylinder head (1) has an oil storing part (17), and the pipe outlet (16*a*) of the oil discharging pipe (16) is soaked into/submerged in the separated oil (18) stored in the oil storing part (17).

With such a configuration, the oil discharging pipe (16) is blocked by the separated oil (18), and therefore the blow-by gas (21) is prevented from entering into the oil discharging guide chamber (7) via the oil discharging pipe (16).

The oil discharging pipe (16) is formed in a cylindrical shape without projections and recesses therein in the basic example shown in FIGS. 10A and 10C.

However, the oil discharging pipe (16) may be formed in a cylindrical shape with a flowing down oil guide groove (16*b*) formed on an inner peripheral surface of the oil discharging pipe (16) to extend along an axial direction. The flowing down oil guide grooves (16*b*) are arranged separately at a predetermined interval in a circumference direction of the oil discharging pipe (16).

In this case, the separated oil (18) flowing down inside the oil discharging pipe (16) is guided vertically downwardly by the flowing down oil guide groove (16*b*), and therefore the separated oil (18) is discharged smoothly from the oil discharging pipe (16).

Figure 12A:
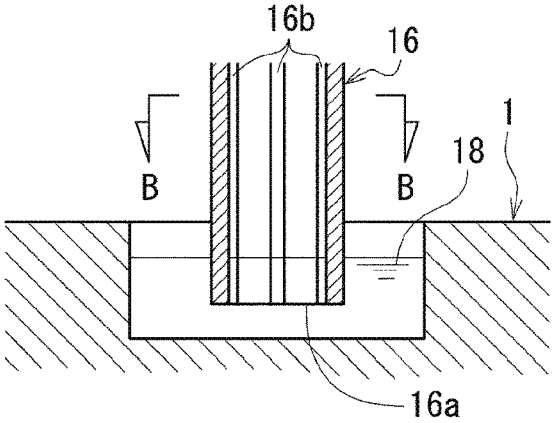
FIGS. 12A to 12F show a first to a third modified examples of an oil discharging pipe used in the engine according to the first embodiment of the present invention, in particular.
Figure 12B:
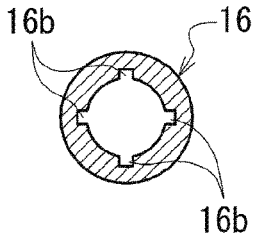
Figure 12C:
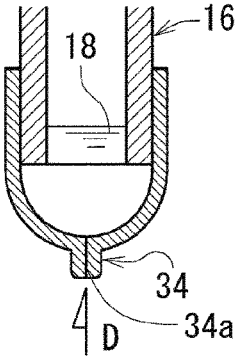
Figure 12D:
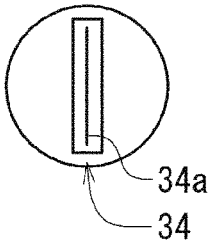
Figure 12E:
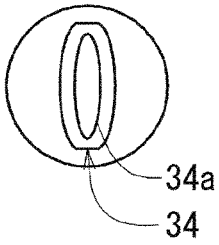

The oil discharging pipe (16) may have a check valve (34) at a lower end part of the oil discharging pipe (16) as a second modified example shown in FIGS. 12C to 12E. In a case in which the check valve (34) is closed when the pressure difference between the inside and the outside of the breather chamber (4) is larger, the blow-by gas (21) is prevented from entering into the oil discharging guide chamber (7) from the oil discharging pipe (16). While, in a case in which the check valve (34) is opened by weight of the separated oil (18) staying on the check valve (34) when the pressure difference between the inside and the outside of the breather chamber (4) is smaller, the separated oil (18) is discharged from the oil discharging pipe (16).

The check valve (34) is made of rubber, and is provided with a slit-like valve port (34*a*). When the check valve (34) is closed as shown in FIGS. 12C and 12D, the valve port (34*a*) is closed by an elastic force of the check valve (34), and when the check valve (34) is opened as shown in FIG.

12E, the valve port (34*a*) is pressed and opened by the weight of the separated oil (18).

The oil discharging pipe (16) according to the second modified example eliminates the need for providing the oil storing part (17) of the cylinder head (1) provided in the basic example and the first modified example. Such a configuration is similar to the oil discharging pipe (16) according to a third modified example shown in FIG. 12F, the oil discharging pipe (16) according to a fourth modified example shown in FIGS. 13A and 13B, and the oil discharging pipe (16) according to a fifth modified example shown in FIG. 13C.

Figure 12F:
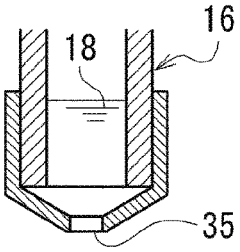

The oil discharging pipe (16) may have an orifice (35) at a lower end part of the oil discharging pipe (16) as the third modified example shown in FIG. 12F. In this case, the separated oil (18) is discharged gradually while being stored on the orifice (35), and therefore the blow-by gas (21) is prevented from entering into the oil discharging guide chamber (7) via the oil discharging pipe (16) by blocking the orifice (35) with the separated oil (18).

Figure 13A:
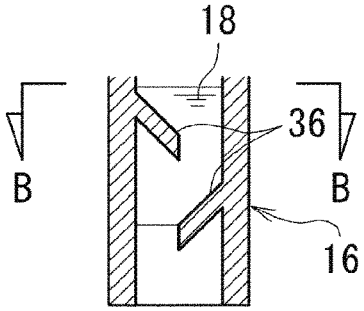
FIGS. 13A to 13C show a fourth and a fifth modified examples of the oil discharging pipe used in the engine according to the first embodiment of the present invention, in particular.
Figure 13B:
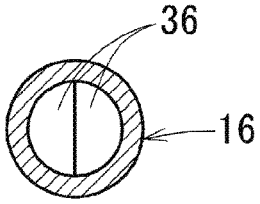

The oil discharging pipe (16) may have a pair of upper and lower baffle plates (36) inclined downwardly and protruded from an inner peripheral surface of a lower end part of the oil discharging pipe (16) as the fourth modified example shown in FIGS. 13A and 13B. In this case, the separated oil (18) is discharged gradually while being stored on the baffle plates (36), and therefore the blow-by gas (21) is prevented from entering into the oil discharging guide chamber (7) via the oil discharging pipe (16) by blocking the oil discharging pipe (16) with the separated oil (18).

Figure 13C:
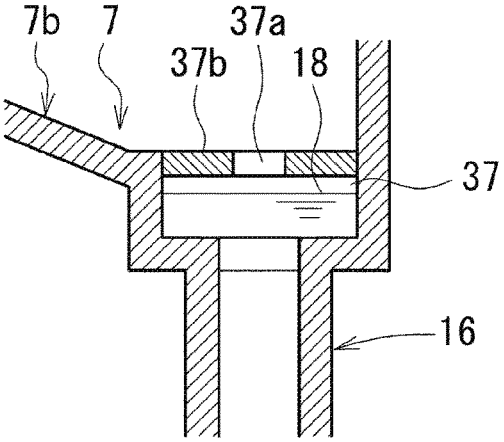

The oil discharging pipe (16) may have a large diameter chamber (37) at an upper end part of the oil discharging pipe (16), and a top part (37*b*) having an orifice (37*a*) at an upper part of the large diameter chamber (37) as the fifth modified example shown in FIG. 13C.

In the fifth modified example, the separated oil (18) normally flows to the oil discharging pipe (16) through the large diameter chamber (37) after passing the orifice (37*a*). At this time, since the separated oil (18) is stored in the oil discharging pipe (16), the blow-by gas (21) can be prevented from entering into the oil discharging guide chamber (7). Further, even if the pressure inside the oil discharging guide chamber (7) is suddenly decreased and the separated oil (18) is sucked up and flowed back from the oil discharging pipe (16) toward the large diameter chamber (37), the separated oil (18) is prevented from being sucked up to the oil discharging guide chamber (7) due to a flow resistance of the orifice (37*a*) when the separated oil (18) passes the orifice (37*a*) from a large space of the large diameter chamber (37).

As shown in FIG. 3, the outlet side oil separating chamber (6*a*) having the blow-by gas outlet (6) and the oil discharging guide chamber (7) are separated by a third partition wall (39), and the outlet side oil separating chamber (6*a*) and the oil discharging guide chamber (7) are communicated with each other via a communication port (40) provided at one side in the lateral direction. In the outlet side oil separating chamber (6*a*), oil mist included in the blow-by gas (21) is condensed on the chamber wall and an oil separating processing of the blow-by gas (21) is performed.

The outlet side oil separating chamber (6*a*) is formed in an elongated shape in the lateral direction. The third partition wall (39) which separates the outlet side oil separating chamber (6*a*) and the oil discharging guide chamber (7) is formed in an elongated shape in the lateral direction and formed integrally with the bottom wall (4*a*) of the breather chamber (4) so as to protrude upwardly from the bottom wall (4*a*).

The whole or a part of an inner surface of the breather chamber (4), an upper surface of the bottom wall (4*a*) of the breather chamber (4), an inner peripheral surface of the separated oil guide groove (14), an inner peripheral surface of the separated oil guide pipe (15), an inner surface of the oil discharging guide chamber (7), the oil discharging guide surface (7*b*), and an inner peripheral surface of the oil discharging pipe (16) may be processed by the following surface treatment.

To provide an oil repellent layer made of fluororesin. In this case, the separated oil (18) is discharged quickly by moving on a surface of the oil repellent layer.

To provide embosses. In this case, an oil storing property on the processed surface is enhanced, a continuous oil film is formed by the separated oil (18) flowing on the processed surface, the following separated oil (18) is moved smoothly on the surface of the oil film, and the separated oil (18) is quickly discharged.

Figure 14A:
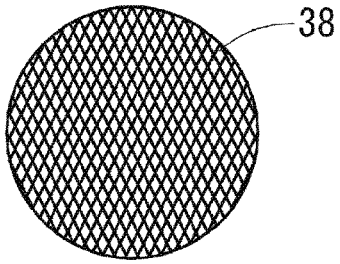
FIGS. 14A to 14C show embosses used in the engine according to the first embodiment of the present invention, in particular.
Figure 14B:
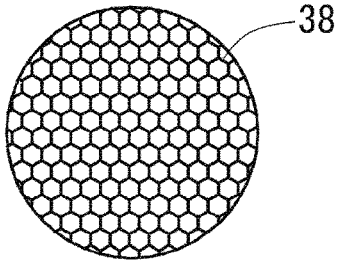
Figure 14C:
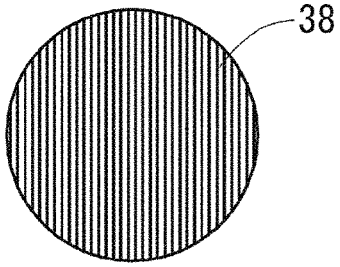
Figure 15A:
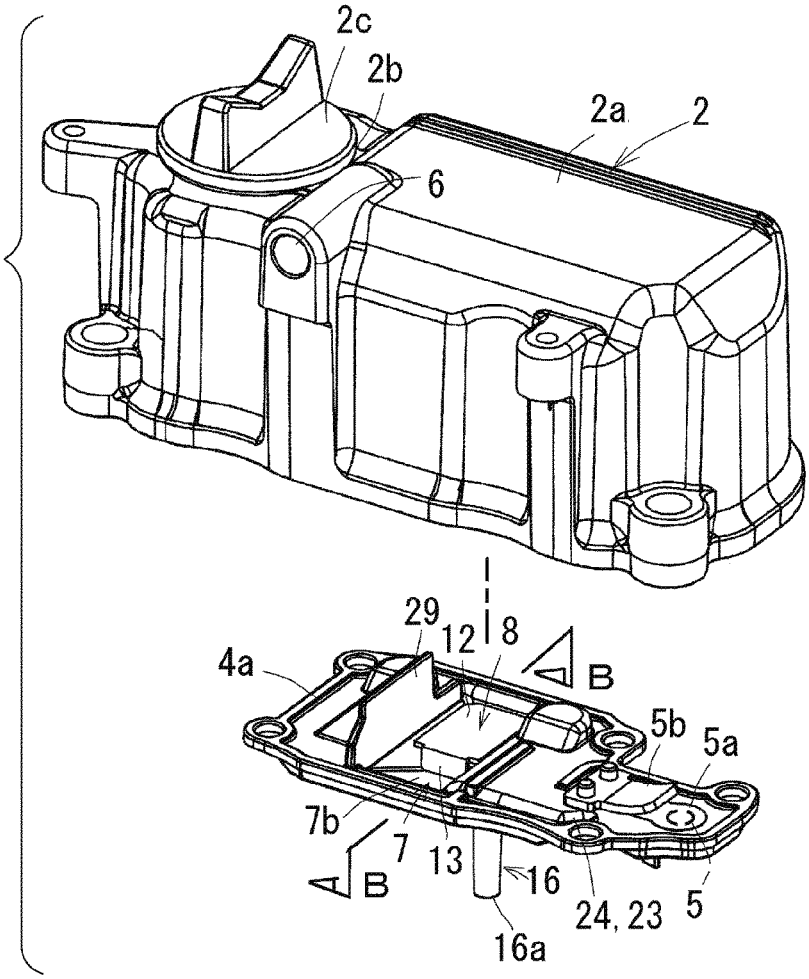
FIGS. 15A and 15B show an engine according to a second embodiment of the present invention, in particular.
Figure 15B:
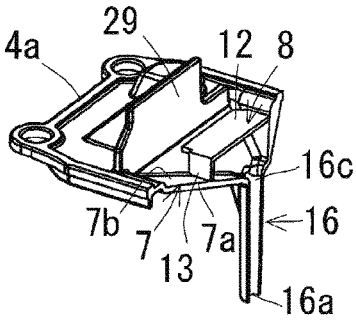

The embosses (38) are formed by cross hatching grooves in a basic example shown in FIG. 14A. However, the embosses (38) may be formed by hexagonal grooves in a first modified example shown in FIG. 14*b*, alternatively formed by parallel grooves along the incline of the oil discharging guide surface (7*b*) in a second modified example shown in FIG. 14C.

Next, an engine according to a second embodiment shown in FIGS. 15 to 23 is described.

In the engine according to the second embodiment, an oil discharging guide chamber (7) has a baffle plate (8) and this configuration is different from the engine according to the first embodiment. Other configurations are similar to those in the engine according to the first embodiment.

Figure 16B:
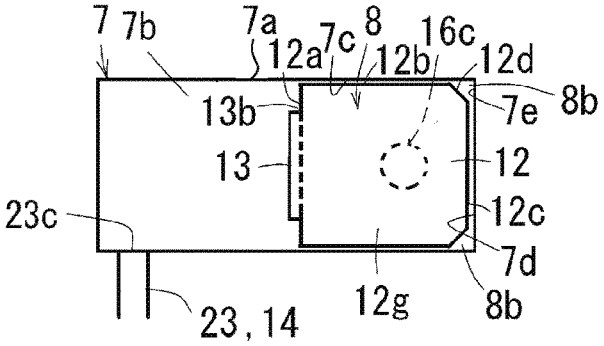
FIGS. 16A to 16C show an oil discharging guide chamber used in the engine according to the second embodiment of the present invention, in particular.
Figure 16A:
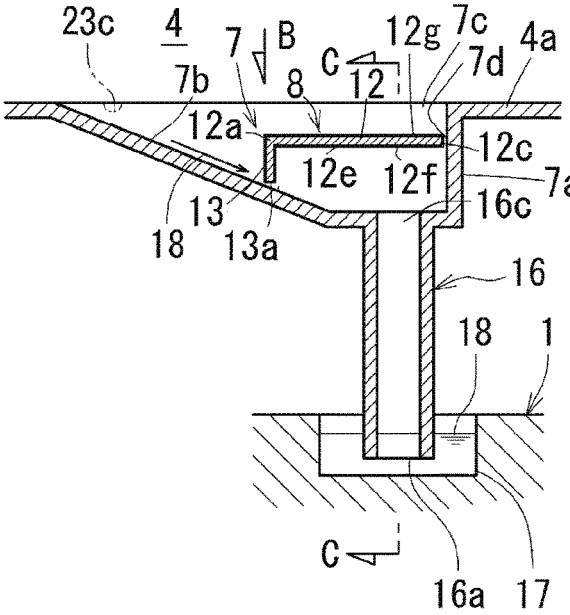
Figure 16C:
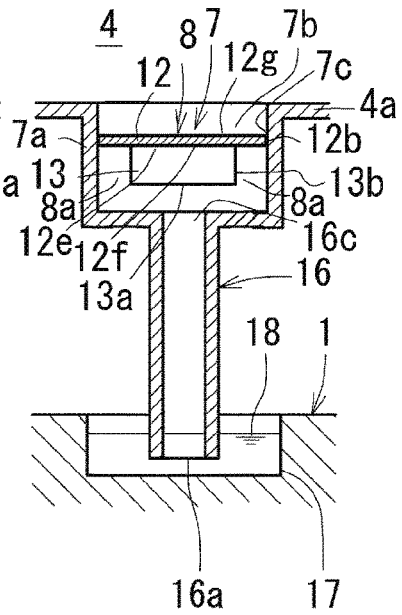
Figure 17D:
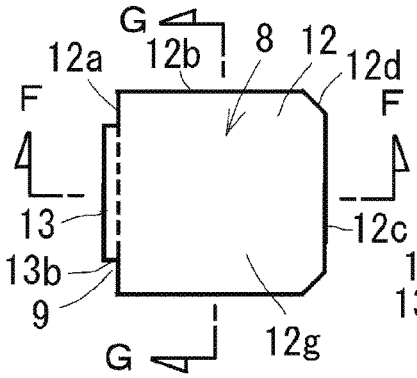
FIGS. 17A to 17G show a basic example of a baffle plate used in the engine according to the second embodiment of the present invention, in particular.
Figure 17E:
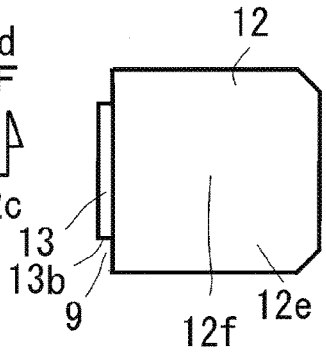
Figure 17B:
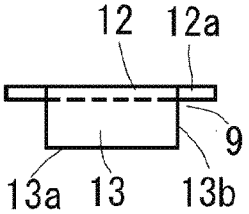
Figure 17A:
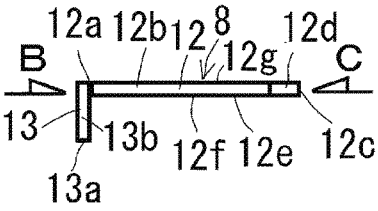
Figure 17C:
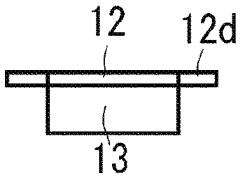
Figure 17F:
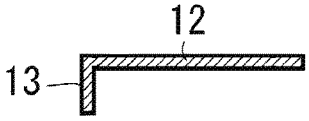
Figure 17G:
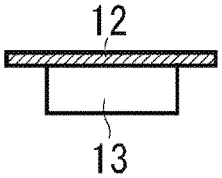
Figure 18D:
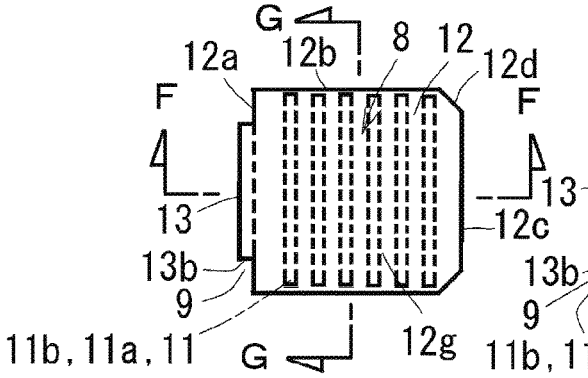
FIGS. 18A to 18G show a first modified example of the baffle plate used in the engine according to the second embodiment of the present invention, in particular.
Figure 18E:
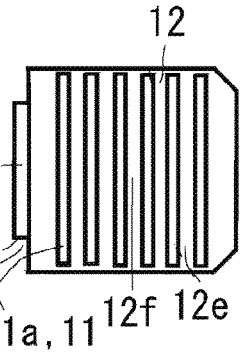
Figure 18B:
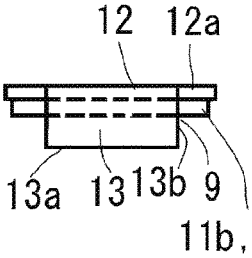
Figure 18A:
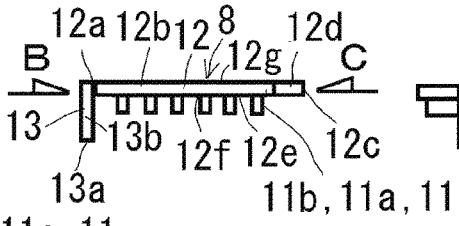
Figure 18C:
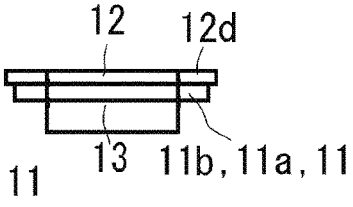
Figure 18F:
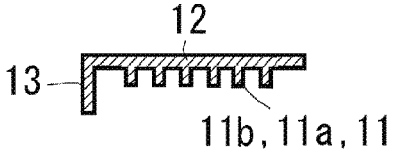
Figure 18G:
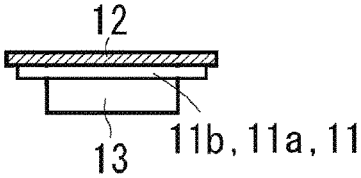
Figure 19D:
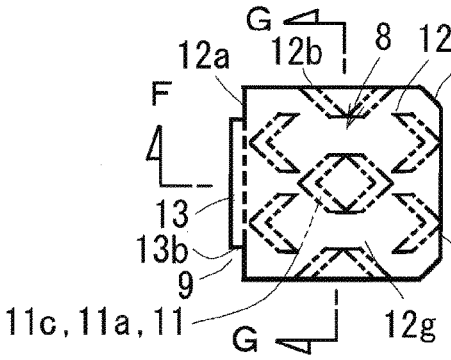
FIGS. 19A to 19G show a second modified example of the baffle plate used in the engine according to the second embodiment of the present invention, in particular.
Figure 19E:
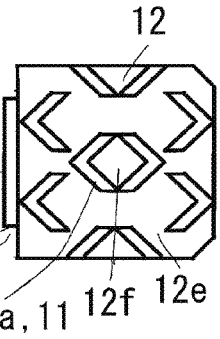
Figure 19B:
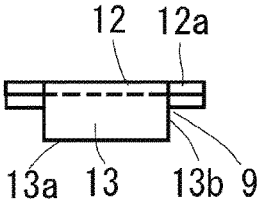
Figure 19A:
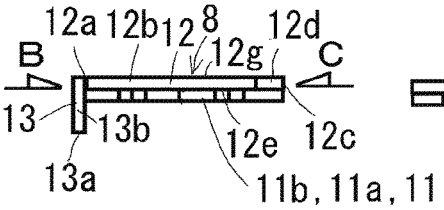
Figure 19C:
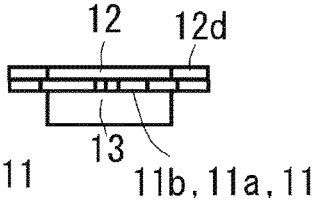
Figure 19F:
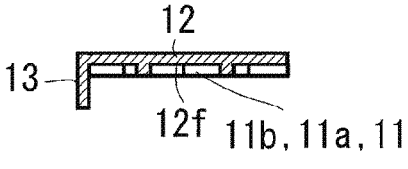
Figure 19G:
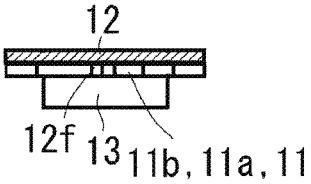
Figure 20D:
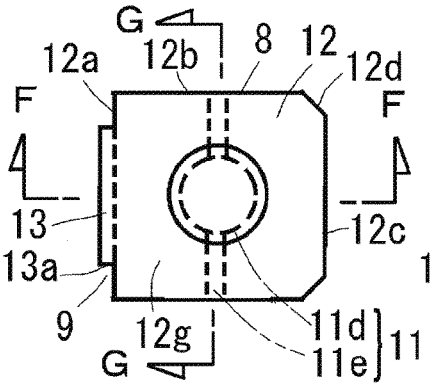
FIGS. 20A to 20G show a third modified example of the baffle plate used in the engine according to the second embodiment of the present invention, in particular.
Figure 20E:
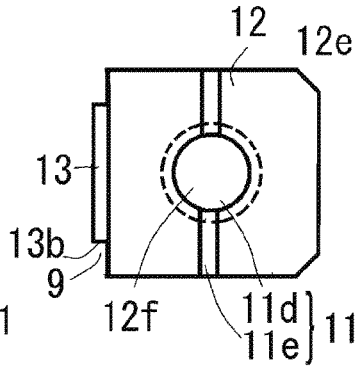
Figure 20B:
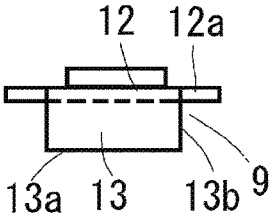
Figure 20A:
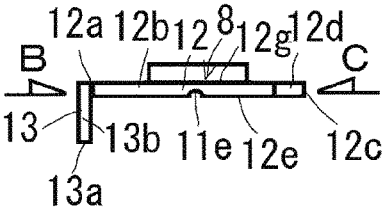
Figure 20C:
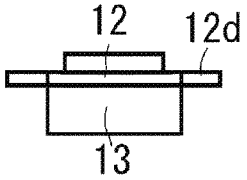
Figure 20F:
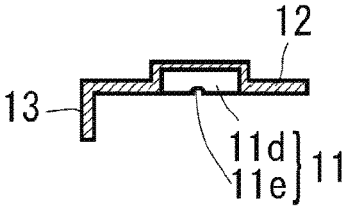
Figure 20G:
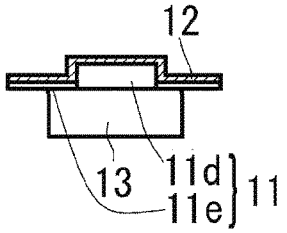
Figure 21D:
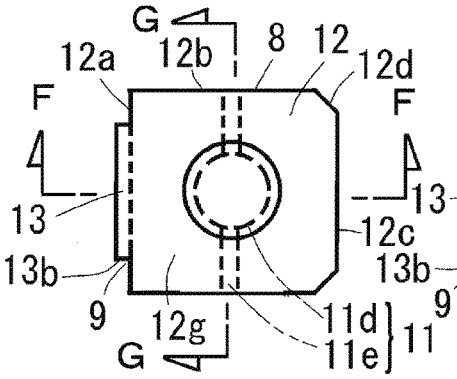
FIGS. 21A to 21G show a fourth modified example of the baffle plate used in the engine according to the second embodiment of the present invention, in particular.
Figure 21E:
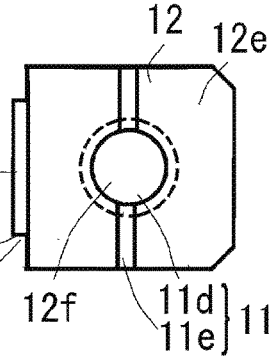
Figure 21B:
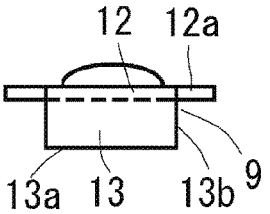
Figure 21A:
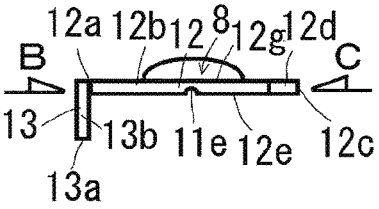
Figure 21C:
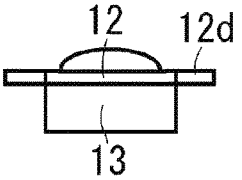
Figure 21F:
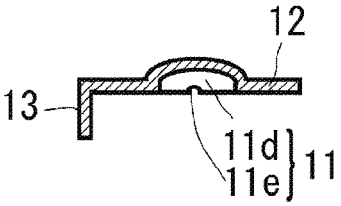
Figure 21G:
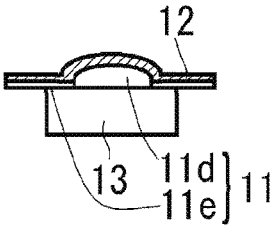
Figure 22D:
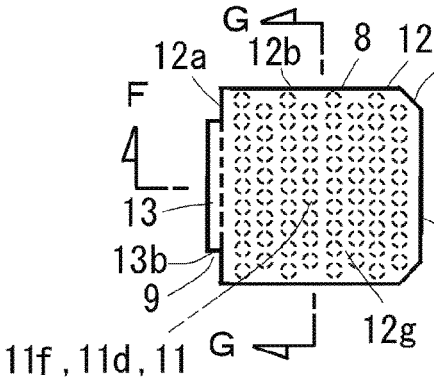
FIGS. 22A to 22G show a fifth modified example of the baffle plate used in the engine according to the second embodiment of the present invention, in particular.
Figure 22E:
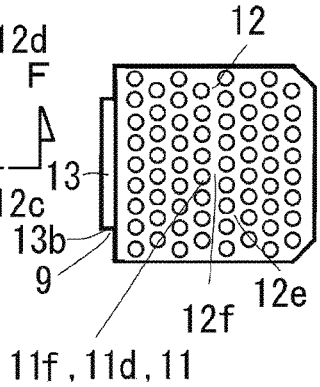
Figure 22B:
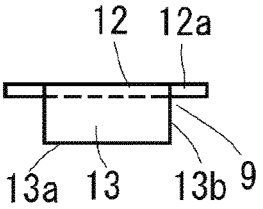
Figure 22A:
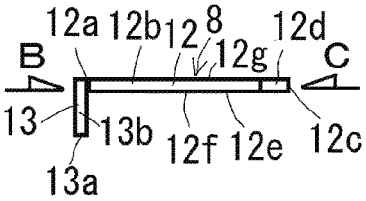
Figure 22C:
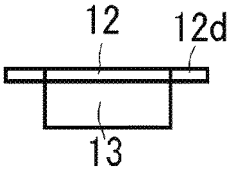
Figure 22F:
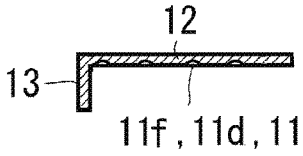
Figure 22G:
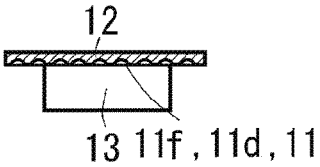
Figure 23D:
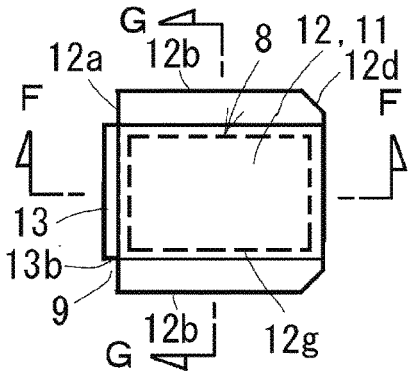
FIGS. 23A to 23G show a sixth modified example of the baffle plate used in the engine according to the second embodiment of the present invention, in particular.
Figure 23E:
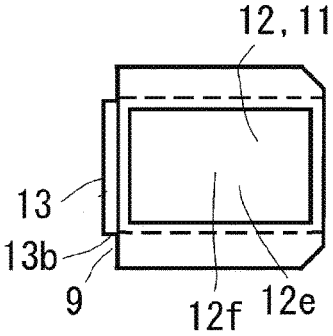
Figure 23B:
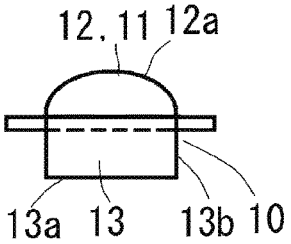
Figure 23A:
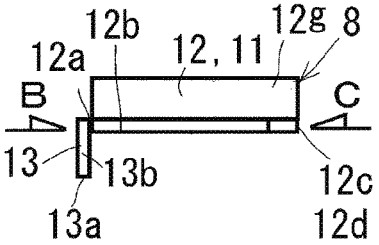
Figure 23C:
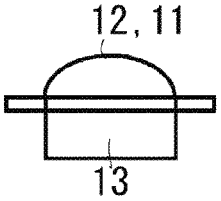
Figure 23F:
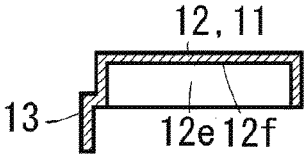
Figure 23G:
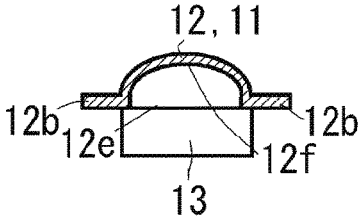

As shown in FIGS. 16A and 16C, the oil discharging guide chamber (7) has the baffle plate (8) which receives the separated oil (18) splashed up from the pipe inlet (16*c*) of the oil discharging pipe (16) due to the backflow of the separated oil (18).

According to the configuration described above, even when the separated oil (18) in the oil storing part (17) is splashed up from the pipe inlet (16*c*) to the oil discharging guide chamber (7) due to the backflow, since the separated oil (18) is received by the baffle plate (8) and is hardly diffused in the oil discharging guide chamber (7), the separated oil (18) hardly flows out of the breather chamber (4) and the oil consumption is reduced.

As shown in FIGS. 16A to 16C, the oil discharging guide chamber (7) has the oil discharging guide surface (7*b*) inclined downwardly toward the pipe inlet (16*c*) of the oil discharging pipe (16).

The baffle plate (8) has a top plate (12) which covers the pipe inlet (16*c*) of the oil discharging pipe (16) from above of the pipe inlet (16*c*).

The top plate (12) has an upper side peripheral edge (12*a*) located at an upper side of the oil discharging guide surface (7*b*).

As shown in FIGS. 16B and 16C, an oil discharging gap (8*a*) is formed between the upper side peripheral edge (12*a*) of the top plate (12) and the oil discharging guide surface (7*b*), and therefore the separated oil (18) flowing down along the oil discharging guide surface (7*b*) is discharged below the top plate (12) via the oil discharging gap (8*a*).

According to the configuration described above, even when the separated oil (18) received by the top plate (12) and diffused around below the top plate (12) is leaked from the oil discharging gap (8*a*), since the separated oil (18) is received by the oil discharging guide surface (7*b*), flowed down along the oil discharging guide surface (7*b*) and returned below the top plate (12) via the oil discharging gap (8*a*), a function for suppressing diffusion of the separated oil (18) becomes high.

As shown in FIGS. 16B and 16C, the oil discharging guide chamber (7) has a side inner peripheral surface (7*c*) located side of the oil discharging guide surface (7*b*).

As shown in FIG. 16A, the baffle plate (8) has a vertical plate (13) protruded downwardly from the upper side peripheral edge (12*a*) of the top plate (12). A lower end edge (13*a*) of the vertical plate (13) is extended along the oil discharging guide surface (7*b*).

As shown in FIGS. 16B and 16C, the vertical plate (13) has a side peripheral edge (13*b*) located at a side of the side inner peripheral surface (7*c*) of the oil discharging guide chamber (7). The oil discharging gap (8*a*) is formed between the side peripheral edge (13*b*) of the vertical plate (13) and the side inner peripheral surface (7*c*) of the oil discharging guide chamber (7).

According to the configuration described above, since a part of the separated oil (18) received by the top plate (12) and diffused around below the top plate (12) is received by the vertical plate (13) and is hardly diffused toward the upper side of the oil discharging guide surface (7*b*), a function for suppressing diffusion of the separated oil (18) in the oil discharging guide chamber (7) becomes high.

As shown in FIGS. 16B and 16C, a peripheral edge of the top plate (12) has a side peripheral edge (12*b*) located at a side of the side inner peripheral surface (7*c*) of the oil discharging guide chamber (7).

The side peripheral edge (12*b*) of the top plate (12) is extended along the side inner peripheral surface (7*c*) of the oil discharging guide chamber (7).

According to the configuration described above, since the separated oil (18) received by the top plate (12) and diffused around below the top plate (12) is hardly leaked from the side peripheral edge (12*b*) of the top plate (12), the function for suppressing diffusion of the separated oil (18) in the oil discharging guide chamber (7) becomes high.

As shown in FIGS. 16A and 16B, the oil discharging guide chamber (7) has a lower side inner peripheral surface (7*d*) located at a lower side of the oil discharging guide surface (7*b*).

The top plate (12) has a lower side peripheral edge (12*c*) located at the lower side of the oil discharging guide surface (7*b*). The lower side peripheral edge (12*c*) of the top plate (12) is extended along the lower side inner peripheral surface (7*d*) of the oil discharging guide chamber (7).

According to the configuration described above, since the separated oil (18) received by the top plate (12) and diffused around below the top plate (12) is hardly leaked from the lower side peripheral edge (12*c*) of the top plate (12), the function for suppressing diffusion of the separated oil (18) in the oil discharging guide chamber (7) becomes high.

As shown in FIGS. 16A to 16C, an oil discharging port (8*b*) is opened between a notched peripheral edge (12*d*) of the top plate (12) and a corner part inner peripheral surface (7*e*) of the oil discharging guide chamber (7) such that the separated oil (18) above the top plate (12) is discharged below the top plate (12) via the oil discharging port (8*b*).

According to the configuration described above, since the separated oil (18) received by the top plate (12) and diffused around below the top plate (12) is hardly leaked from the side peripheral edge (12*b*) or the lower side peripheral edge (12*c*) of the top plate (12), the function for suppressing diffusion of the separated oil (18) in the oil discharging guide chamber (7) becomes high.

Further, since the separated oil (18) above the top plate (12) is discharged from an oil discharging port (8*b*) toward below the top plate (12) and the separated oil (18) is hardly diffused by the blow-by gas (21) passing above the top plate (12), the function for suppressing diffusion of the separated oil (18) in the oil discharging guide chamber (7) becomes high.

A basic example and modified examples of the baffle plate are described.

FIGS. 17A to 17G show the basic example of the baffle plate.

The baffle plate (8) according to the basic example has the top plate (12) and the vertical plate (13), each of them is formed by a rectangular flat plate.

The top plate (12) has the upper side peripheral edge (12*a*), both of the side peripheral edges (12*b*), (12*b*), the lower side peripheral edge (12*c*), the notched peripheral edge (12*d*), an upper surface (12*g*), and a lower surface (12*e*). Each of the upper surface (12*g*) and the lower surface (12*e*) is formed in a flat surface. The lower surface (12*e*) has an oil receiving surface (12*f*) at a center part thereof. The oil receiving surface (12*f*) is formed to face the pipe inlet (16*c*) of the oil discharging pipe (16).

FIGS. 18A to 18G through 23A to 23G show a first through a sixth modified examples of the baffle plate (8), respectively.

In the first through the sixth modified examples, the top plate (12) has an oil diffusion suppressing part (11) which suppresses the diffusion of the separated oil (18), which is splashed up from the pipe inlet (16*c*) of the oil discharging pipe (16) due to the backflow, toward a side of the oil discharging gap (8*a*) shown in FIG. 16C.

According to the configuration described above, since the separated oil (18) received by the top plate (12) and diffused around below the top plate (12) is suppressed to be diffused toward the side of the oil discharging gap (8*a*) by the oil diffusion suppressing part (11), the function for suppressing diffusion of the separated oil (18) in the oil discharging guide chamber (7) becomes high.

Other configurations and functions in the first through the sixth modified examples are similar to those in the basic example shown in FIGS. 17A to 17G, and therefore the same reference numerals are assigned to the components in the FIGS. 18A to 18G through 23A to 23G as those in the basic example in FIGS. 17A to 17G.

FIGS. 18A to 18G and 19A to 19G show the first and the second modified examples of the baffle plate (8).

In the first and the second modified examples, the oil diffusion suppressing part (11) has a rib (11*a*) protruding from the lower surface (12*e*) of the top plate (12) so as to extend between the oil receiving surface (12*f*) of the top plate (12) and the oil discharging gap (8*a*).

According to the configuration described above, since the separated oil (18) received by the oil receiving surface (12*f*) and diffused around below the top plate (12) is suppressed to be diffused toward the side of the oil discharging gap (8*a*) by the rib (11*a*), the function for suppressing diffusion of the separated oil (18) in the oil discharging guide chamber (7) becomes high.

In the first modified example shown in FIGS. 18A to 18G, the rib (11*a*) has a straight rib (11*b*) extended toward the side peripheral edge (12*b*) of the top plate (12).

According to the configuration described above, since the separated oil (18) received by the oil receiving surface (12*f*) and diffused around below the top plate (12) is received by the straight rib (11*b*) and directed toward a side of the side peripheral edge (12*b*) of the top plate (12), the separated oil (18) is suppressed to be diffused toward the side of the oil discharging gap (8*a*), and therefore the function for suppressing diffusion of the separated oil (18) in the oil discharging guide chamber (7) becomes high.

The straight rib (11*b*) is provided horizontally in a direction along the vertical plate (13), and the straight ribs (11*b*) are arranged in a parallel manner at a predetermined interval between the upper side peripheral edge (12*a*) and the lower side peripheral edge (12*c*) of the top plate (12).

In the second modified example shown in FIGS. 19A to 19G, the rib (11*a*) has a surrounding rib (11*c*) surrounding the oil receiving surface (12*f*).

According to the configuration described above, since the separated oil (18) received by the oil receiving surface (12*f*) and diffused around below the top plate (12) is received by the surrounding rib (11*c*) and bounced back by the oil receiving surface (12*f*), the function for suppressing diffusion of the separated oil (18) in the oil discharging guide chamber (7) becomes high.

The surrounding rib (11*c*) is formed in a rhombus shape in which openings of V-shape ribs abut on each other so as to surround the oil receiving surface (12*f*). Further, V-shape ribs having sharp corner parts directed toward the upper side peripheral edge (12*a*) and the lower side peripheral edge (12*c*) respectively are provided around the surrounding rib (11*c*).

In the third through the fifth modified examples shown in FIGS. 20A to 20G through 22A to 22G respectively, the oil diffusion suppressing part (11) has a recess (11*d*) recessed upwardly on the oil receiving surface (12*f*) of the top plate (12).

According to the configuration described above, the separated oil (18) received by the oil receiving surface (12*f*) is suppressed to be diffused around by entering into the recess (11*d*), and therefore the function for suppressing diffusion of the separated oil (18) in the oil discharging guide chamber (7) becomes high.

In the third and the fourth modified examples shown in FIGS. 20A to 20G and 21A to 21G respectively, the oil diffusion suppressing part (11) has a groove (11*e*) extended from the recess (11*d*) toward the side peripheral edge (12*b*) of the top plate (12).

According to the configuration described above, since a part of the separated oil (18) received by the oil receiving surface (12*f*) is suppressed to be diffused toward the side of the oil discharging gap (8*a*) by being directed toward the side peripheral edge (12*b*) of the top plate (12) from the recess (11*d*) via the groove (11*e*), the function for suppressing diffusion of the separated oil (18) in the oil discharging guide chamber (7) becomes high.

The recess (11*d*) in the third modified example shown in FIGS. 20A to 20G is a single cylindrical recess formed on the oil receiving surface (12*f*).

The recess (11*d*) in the fourth modified example shown in FIGS. 21A to 21G is a single partially spherical recess formed on the oil receiving surface (12*f*).

In the fifth modified example shown in FIGS. 22A to 22G, the recess (11*d*) has a plurality of dimples (11*f*).

According to the configuration described above, since the separated oil (18) received by the oil receiving surface (12*f*) is suppressed to be diffused around by entering into a plurality of the dimples (11*f*), the function for suppressing diffusion of the separated oil (18) in the oil discharging guide chamber (7) becomes high.

The dimple (11*f*) in the fifth modified example is formed in a half spherical shape; however it may be formed by a partially spherical recess, a cylindrical recess, a conical recess, a pyramid recess, a truncated conical recess, or a truncated pyramid recess.

The dimple (11*f*) in the fifth modified example is not limited to be formed on the oil receiving surface (12*f*) but formed in the whole area of the lower surface (12*e*) of the top plate (12).

In the sixth modified example shown in FIGS. 23A to 23G, the oil diffusion suppressing part (11) has an arc-shaped top plate (12) in which the oil receiving surface (12*f*) is protruded upwardly with respect to both sides of the side peripheral edges (12*b*).

According to the configuration described above, since the separated oil (18) received by the oil receiving surface (12*f*) is suppressed to be diffused toward the side of the oil discharging gap (8*a*) by being guided toward the both sides of the side peripheral edges (12*b*) of the top plate (12) along the lower surface (12*e*) of the arc-shaped top plate (12), the function for suppressing diffusion of the separated oil (18) in the oil discharging guide chamber (7) becomes high.

The lower surface (12*e*) of the top plate (12) may have the dimple (11*f*) in the fifth modified example.

What is claimed is:

1. An engine comprising:

a cylinder head;

a cylinder head cover mounted above the cylinder head;

a rocker arm covered by the cylinder head cover;

a breather chamber provided inside the cylinder head cover;

wherein, as a front-rear direction is defined by a longitudinal direction of the cylinder head cover, the breather chamber has a blow-by gas inlet at one side in the front-rear direction, a blow-by gas outlet at another side in the front-rear direction, and an oil discharging guide chamber at an intermediate position in the front-rear direction, and wherein the blow-by gas inlet is opened on a bottom wall of the breather chamber;

a protrusion extending downwardly forming a peripheral wall of the oil discharging guide chamber, the downward protrusion being relative to the bottom wall of the breather chamber between the blow-by gas inlet and the rocker arm; provided at a side of the blow-by gas outlet;

the breather chamber has an oil discharging pie at a lower part of the oil discharging guide chamber;

the cylinder head has an oil storing part;

a pipe outlet of the oil discharging pipe extends into the separated oil stored in the oil storing part;

the protrusion protrudes downwardly from the bottom wall of the breather chamber to a place where the protrusion overlaps an input end portion of the rocker arm provided at the side of the blow-by gas outlet when viewed in a direction parallel to the front-rear direction; and the oil discharging pipe is disposed at a place where the oil discharging pipe overlaps a provided at the rocker arm provided at the side of the blow-by gas outlet when viewed in the direction parallel to the front-rear direction.

2. The engine according to claim 1, wherein:

the breather chamber has an inlet side oil separating chamber having the blow-by gas inlet, and a blow-by gas bypass passage, and the breather chamber is configured to guide blow-by gas coming out of the inlet side oil separating chamber to the oil discharging guide chamber via the blow-by gas bypass passage.

3. The engine according to claim 2, wherein:

the breather chamber has a partition wall which separates the blow-by gas bypass passage and the oil discharging guide chamber, and a separated oil guide passage, and the separated oil guide passage has a start section provided in the inlet side oil separating chamber, an intermediate section provided at a first end of the blow-by gas bypass passage, and an end section provided below the partition wall such that the separated oil guide passage is led to the oil discharging guide chamber.

4. The engine according to claim 3, wherein the separated oil guide passage is formed by a groove.

5. The engine according to claim 3, wherein the separated oil guide passage is formed by a pipe.

6. The engine according to claim 3, wherein:

the oil discharging guide chamber has an oil discharging guide surface on its inner surface, and the oil discharging guide surface is formed to be inclined downwardly from the end part of the separated oil guide passage toward the oil discharging pipe.

7. The engine according to claim 3, wherein:

the oil discharging guide chamber has an oil discharging guide surface on its inner surface, and the oil discharging guide surface is formed by a downwardly stepped zigzag face from the end part of the separated oil guide passage toward the oil discharging pipe.

8. The engine according to claim 1, wherein the oil discharging guide chamber has a baffle plate which receives the separated oil splashed up from a pipe inlet of the oil discharging pipe by a backflow.

9. The engine according to claim 8, wherein:

the oil discharging guide chamber has an oil discharging guide surface inclined downwardly toward the pipe inlet of the oil discharging pipe, the baffle plate has a top plate which covers the pipe inlet of the oil discharging pipe from above of the pipe inlet, the top plate has an upper side peripheral edge located at an upper side of the oil discharging guide surface, an oil discharging gap is formed between the upper side peripheral edge of the top plate and the oil discharging guide surface, and the separated oil flowed down along the oil discharging guide surface is discharged below the top plate via the oil discharging gap.

10. The engine according to claim 9, wherein:

the oil discharging guide chamber has a side inner peripheral surface located on the side of the oil discharging guide surface, the baffle plate has a vertical plate extended downwardly from the upper side peripheral edge of the top plate, a lower edge of the vertical plate is extended along the oil discharging guide surface, the vertical plate has a side peripheral edge located at a side of the side inner peripheral surface of the oil discharging guide chamber, and an oil discharging gap is formed between the side peripheral edge of the vertical plate and the side inner peripheral surface of the oil discharging guide chamber.

11. The engine according to claim 9, wherein:

the oil discharging guide chamber has a side inner peripheral surface located on the side of the oil discharging guide surface, a peripheral edge of the top plate has a side peripheral edge located at a side of the side inner peripheral surface of the oil discharging guide chamber, and the side peripheral edge of the top plate is configured to extend along the side inner peripheral surface of the oil discharging guide chamber.

12. The engine according to claim 9, wherein:

the oil discharging guide chamber has a lower side inner peripheral surface located at a lower side of the oil discharging guide surface, the top plate has a lower side peripheral edge located at a lower side of the oil discharging guide surface, and the lower side peripheral edge of the top plate is configured to extend along the lower side inner peripheral surface of the oil discharging guide chamber.

13. The engine according to claim 9, wherein:

the oil discharging guide chamber has a side inner peripheral surface located side of the oil discharging guide surface, a lower side inner peripheral surface located at a lower side of the oil discharging guide surface, and a corner part inner peripheral surface located at a border area between the side inner peripheral surface and the lower side inner peripheral surface, the top plate has a side peripheral edge located at a side of the side inner peripheral surface of the oil discharging guide chamber, a lower side peripheral edge located at a lower side of the oil discharging guide surface, and a notched peripheral edge located at a border area between the side peripheral edge and the lower side peripheral edge, the side peripheral edge of the top plate is configured to extend along the side inner peripheral surface of the oil discharging guide chamber, the lower side peripheral edge of the top plate is configured to extend along the lower side inner peripheral surface of the oil discharging guide chamber, and an oil discharging port is opened between the notched peripheral edge of the top plate and the corner part inner peripheral surface of the oil discharging guide chamber such that the separated oil above the top plate is discharged below the top plate via the oil discharging port.

14. The engine according to claim 9, wherein the top plate has an oil diffusion suppressing part configured to suppress the separated oil, which is splashed up from the pipe inlet of the oil discharging pipe by a backflow, to be diffused toward a side of the oil discharging gap.

15. The engine according to claim 14, wherein:

the lower surface of the top plate has an oil receiving surface facing the pipe inlet of the oil discharging pipe, and the oil diffusion suppressing part has a rib protruded from the lower surface of the top plate and extended between the oil receiving surface of the top plate and the oil discharging gap.

16. The engine according to claim 15, wherein:

the top plate has a side peripheral edge located at a side of the side inner peripheral surface of the oil discharging guide chamber, and the rib has a straight rib extended toward the side peripheral edge of the top plate.

17. The engine according to claim 15, wherein the rib has a surrounding rib surrounding the oil receiving surface.

18. The engine according to claim 14, wherein:

the lower surface of the top plate has an oil receiving surface facing the pipe inlet of the oil discharging pipe, and the oil diffusion suppressing part has a recess recessed upwardly on the oil receiving surface of the top plate.

19. The engine according to claim 18, wherein:

a peripheral edge of the top plate has a side peripheral edge located at a side of the side inner peripheral surface of the oil discharging guide chamber, and the oil diffusion suppressing part has a groove extended from the recess toward the side peripheral edge of the top plate.

20. The engine according to claim 18, wherein the recess includes a plurality of dimples.

21. The engine according to claim 14, wherein:

the lower surface of the top plate has an oil receiving surface facing the pipe inlet of the oil discharging pipe, the top plate has a side peripheral edge located at a side of the side inner peripheral surface of the oil discharging guide chamber, and the oil diffusion suppressing part has an arc-shaped top plate with the oil receiving surface being protruded upwardly with respect to both side peripheral edges.

* * * * *